US006000266A

United States Patent [19]

Strecker et al.

[11] Patent Number: 6,000,266

[45] Date of Patent: Dec. 14, 1999

[54] ROLL-FORMING MACHINE WITH REVERSIBLE RAFTS

[75] Inventors: Albert Strecker, Hesston; David Sheehan, Moundridge, both of Kans.

[73] Assignee: The Bradbury Company, Moundridge, Kans.

[21] Appl. No.: 08/932,743

[22] Filed: Sep. 17, 1997

[51] Int. Cl.[6] ..... B21B 31/08

[52] U.S. Cl. ..... 72/181; 72/238; 72/226

[58] Field of Search ..... 72/181, 179, 226, 72/249, 238

[56] References Cited

U.S. PATENT DOCUMENTS

| | | | |
|---|---|---|---|
| 1,125,984 | 1/1915 | Dumas | 72/181 |
| 1,669,411 | 5/1928 | Clark . | |
| 2,102,355 | 12/1937 | Cummins | 80/54 |
| 2,195,398 | 4/1940 | Duda | 64/30 |
| 2,343,680 | 3/1944 | Linderme, Sr. | 205/7 |
| 2,561,634 | 7/1951 | Picton | 153/54 |
| 2,601,794 | 7/1952 | Wood | 80/55 |
| 2,664,019 | 12/1953 | Henderson | 80/35 |
| 2,774,263 | 12/1956 | Leufven | 80/56 |
| 3,006,225 | 10/1961 | Mamas | 80/56 |
| 3,345,849 | 10/1967 | Lowy | 72/249 |
| 3,348,403 | 10/1967 | Bartley | 72/237 |
| 3,452,568 | 7/1969 | Vihl | 72/137 |
| 3,724,251 | 4/1973 | Wegner | 72/203 |
| 3,823,592 | 7/1974 | Colbath | 72/181 |
| 4,033,165 | 7/1977 | Arimura et al. | 72/205 |
| 4,145,905 | 3/1979 | Mattie | 72/177 |
| 4,187,710 | 2/1980 | Stikeleather | 72/204 |
| 4,237,714 | 12/1980 | Polukhin et al. | 72/242 |
| 4,368,633 | 1/1983 | Nogota | 72/239 |
| 4,724,695 | 2/1988 | Stoehr | 72/181 |
| 4,787,232 | 11/1988 | Hayes | 72/176 |
| 4,912,956 | 4/1990 | Matricon et al. | 72/243 |
| 4,959,986 | 10/1990 | Kranis, Sr. | 72/129 |
| 4,969,347 | 11/1990 | Matsuo et al. | 72/247 |
| 4,974,435 | 12/1990 | Vandenbroucke | 72/176 |
| 5,158,002 | 10/1992 | Matsunaga et al. | 83/479 |
| 5,163,311 | 11/1992 | McClain et al. | 72/181 |
| 5,644,942 | 7/1997 | Bradbury | 72/238 |

FOREIGN PATENT DOCUMENTS

| | | |
|---|---|---|
| 1 777 039 | 10/1971 | Germany . |
| 42-4763 | 2/1967 | Japan . |
| 1085708 | 4/1984 | U.S.S.R. . |

*Primary Examiner*—Daniel C. Crane

*Attorney, Agent, or Firm*—Marshall, O'Toole, Gerstein, Murray & Borun

[57] ABSTRACT

A roll-forming apparatus of the type used to transform a flat web or sheet of metal into a component having various cross-sectional shapes is provided with a first elongate base portion with an axis extending in a longitudinal direction, a second elongate base portion with an axis disposed generally parallel to the longitudinal direction of the axis of the first base portion, and a drive mechanism associated with the first and second base portions, the drive mechanism having a coupler associated with the first base portion, a raft plate supported by the first base portion, and a plurality of roll-forming stations supported by the raft plate. At least one of the roll-forming stations is provided with a plurality of forming rolls, a plurality of rotatable spindles for supporting the forming rolls, a first coupler adapted to be coupled to the coupler of the drive mechanism and being operatively connected to one of the spindles, and a second coupler adapted to be coupled to the coupler of the drive mechanism and being operatively connected to one of the spindles.

15 Claims, 3 Drawing Sheets

ROLL-FORMING MACHINE WITH REVERSIBLE RAFTS

BACKGROUND OF THE INVENTION

The present invention relates to a roll-forming machine of the type which is used to form components, such as metal panels having a non-linear cross-sectional shape.

Roll-forming machines typically include a plurality of roll-forming stations that are used to transform a planar sheet of metal into a component having various cross-sectional shapes. Each of the roll-forming stations typically includes a pair of frame members in which a pair of rotatable spindles are journalled, one spindle disposed directly above the other, and a number of generally cylindrical plates, referred to herein as "forming rolls" which are used to gradually deform the planar sheet into the desired shape. The two spindles may be interconnected by a pair of enmeshed gears, one gear mounted to each spindle, so that rotation of one of the spindles causes the other spindle to rotate. Alternatively, each of the two spindles may be driven by a separate coupler of a drive mechanism.

The sheet of material is forced through the roll-forming machine by friction between the sheet and the rotating forming rolls. The forming rolls of some of the roll-forming stations, e.g. the forming rolls of every other station, are rotatably driven by a motorized drive mechanism to ensure that there is enough driving power to force the sheet through the machine.

Some conventional roll-forming machines have a pair of elongate base portions disposed in a generally side-by-side relationship, with a number of drive mechanisms disposed between the base portions. Each of the base portions supports a plurality of roll-forming stations, and the roll-forming stations supported by each base portion can form a finished product having a different cross-sectional shape. For example, the roll-forming stations supported by one base portion can form a C-shaped purlin, while the roll-forming stations supported by the other base portion can form a Z-shaped purlin.

In one such prior art roll-forming machine, a number of drive mechanisms are disposed between the two base portions. Each drive mechanism has a pair of horizontally translatable couplers, each of which extends horizontally outwardly from a respective side of each drive mechanism. The roll-forming machine has a plurality of raft plates supported by each of the two base portions, each of the raft plates supporting a plurality of roll-forming stations.

At least one of the roll-forming stations mounted to each raft plate has a single coupler mounted to one end of the lower spindle of the roll-forming station. The coupler extends horizontally from a side plate of the roll-forming station towards one of the couplers of an adjacent drive mechanism. When the coupler of the drive mechanism is translated outwardly towards the roll-forming station, that coupler engages the coupler attached to the lower spindle of the roll-forming station so that rotation of the coupler of the drive mechanism causes the two spindles of the roll-forming station to rotate.

SUMMARY OF THE INVENTION

The invention relates to a roll-forming apparatus and method which is used to transform a flat web or sheet of metal into a component having various cross-sectional shapes.

In one aspect, the invention is directed to a roll-forming apparatus having a base portion, a drive mechanism with a coupler associated with the base portion, a raft plate supported by the base portion, and a plurality of roll-forming stations supported by the raft plate. At least one of the roll-forming stations is provided with a plurality of forming rolls, a plurality of rotatable spindles for supporting the forming rolls, a first coupler adapted to be coupled to the coupler of the drive mechanism and being operatively connected to one of the spindles, and a second coupler adapted to be coupled to the coupler of the drive mechanism and being operatively connected to one of the spindles.

One of the couplers of the roll-forming station may extend from a first side of the roll-forming station in a direction towards the coupler of the drive mechanism, and the other coupler of the roll-forming station may extend from a second side of the roll-forming station in a direction away from the coupler of the drive mechanism. Both of the couplers of the roll-forming station may be mounted on one of the spindles of the roll-forming station.

The roll-forming station may also include a pair of spaced-apart frame members for supporting the spindles, each of the spindles passing through both of the frame members, a first gear connected to a first of the spindles, and a second gear connected to a second of the spindles, the first and second gears being enmeshed so that rotation of the first spindle causes the second spindle to rotate.

In another aspect, the invention is directed to a roll-forming apparatus having a first elongate base portion with an axis extending in a longitudinal direction, a second elongate base portion with an axis disposed generally parallel to the longitudinal direction of the axis of the first base portion, and a drive mechanism associated with the first and second base portions, the drive mechanism having a first coupler associated with the first base portion, a second coupler associated with the second base portion, a raft plate supported by the first base portion, and a plurality of roll-forming stations supported by the raft plate.

At least one of the roll-forming stations is provided with a plurality of forming rolls, a plurality of rotatable spindles for supporting the forming rolls, a first coupler adapted to be coupled to one of the couplers of the drive mechanism and being operatively connected to one of the spindles, and a second coupler adapted to be coupled to one of the couplers of the drive mechanism and being operatively connected to one of the spindles.

In another aspect, the invention is directed to a roll-forming apparatus having a raft plate, a plurality of roll-forming stations supported by the raft plate, one of the roll-forming stations having a plurality of forming rolls, a plurality of rotatable spindles for supporting the forming rolls, a first coupler extending in a first direction and being adapted to be coupled to a coupler of a drive mechanism, the first coupler being operatively connected to one of the spindles, and a second coupler extending in a second direction and being adapted to be coupled to a coupler of the drive mechanism, the second coupler being operatively connected to one of the spindles so that the spindles may be rotatably driven via either the first or second couplers.

The invention is also directed to a method of operating a roll-forming apparatus having a first base portion, a second base portion, a drive mechanism, and a plurality of roll-forming stations supported on a raft plate including a first roll-forming station and a second roll-forming station, each of the roll-forming stations having a different forming-roll configuration and one of the roll-forming stations having a pair of couplers.

The method includes the steps of (a) mounting the roll-forming stations supported by the raft onto the first base portion of the roll-forming apparatus so that the roll-forming stations have an orientation, (b) causing the drive mechanism to engage the first coupler of the one roll-forming station, (c) passing a sheet of material through the roll-forming stations supported by the raft plate in a feed direction so that the sheet of material is deformed first by the first roll-forming station and then by the second roll-forming station, (d) causing the first coupler of the one roll-forming station to become disengaged from the drive mechanism, (e) moving the roll-forming stations supported by the raft from the first base portion to the second first base portion so that the roll-forming stations have the same orientation as when the roll-forming stations were mounted during step (a), (f) causing the drive mechanism to engage the second coupler of the one roll-forming station, and (g) passing a sheet of material through the roll-forming stations supported by the raft plate in a feed direction so that the sheet of material is deformed first by the first roll-forming station and then by the second roll-forming station.

The features and advantages of the invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
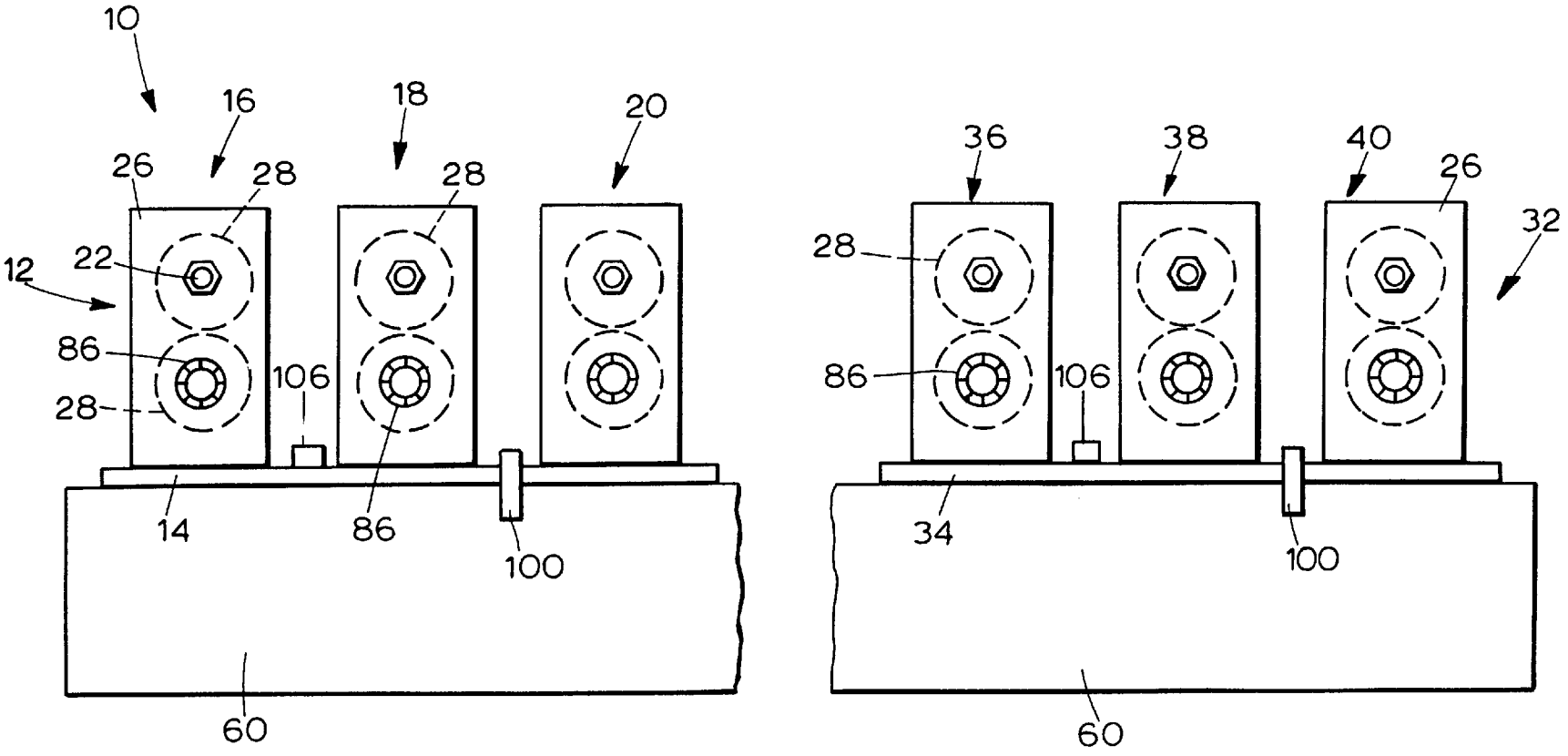
FIG. 1 is a schematic side view of a portion of a preferred embodiment of a roll-forming machine in accordance with the invention.

FIG. 1 is a schematic side view of a preferred embodiment of a roll-forming machine 10 in accordance with the invention which is used to transform a flat web or sheet of metal into a component having various cross-sectional shapes. Referring to FIG. 1, the roll-forming machine 10 has a first raft assembly 12 composed of a raft plate 14 and a plurality of roll-forming stations 16, 18, 20 mounted to and supported by the raft plate 14.

Each of the roll-forming stations 16, 18, 20 has an upper spindle 22 and a lower spindle 24 (see FIG. 2) which are rotatably journalled in a pair of spaced-apart frame members 26. A plurality of forming rolls 28 (shown schematically) are mounted to each of the upper and lower spindles 22, 24. The forming rolls 28 used in each of the roll-forming stations 16, 18, 20 have different profiles, so that each of the roll-forming stations 16, 18, 20 imparts a unique set of bends to the metal sheet or web as it passes through the stations 16, 18, 20. The particular construction of the roll-forming stations, which could take many forms in accordance with the invention, could be in accordance with U.S. Pat. No. 5,644,942 to Bradbury, the disclosure of which is incorporated herein by reference.

The roll-forming machine 10 has a second raft assembly 32, which is shown in the right-hand portion of FIG. 1 to include a raft plate 34 which supports a plurality of roll-forming stations 36, 38, 40, which are identical to the roll-forming stations 16, 18, 20, except that the profiles of the forming rolls 28 are different. Although each of the raft assemblies 12, 32 is shown in FIG. 1 to have three roll-forming stations, it should be appreciated that a different number of roll-forming stations could be mounted on each raft plate, depending on the particular roll-forming application. Also, although only two raft assemblies 12, 32 are shown in FIG. 1, the roll-forming machine 10 may have one or more of such raft assemblies.

Figure 2:
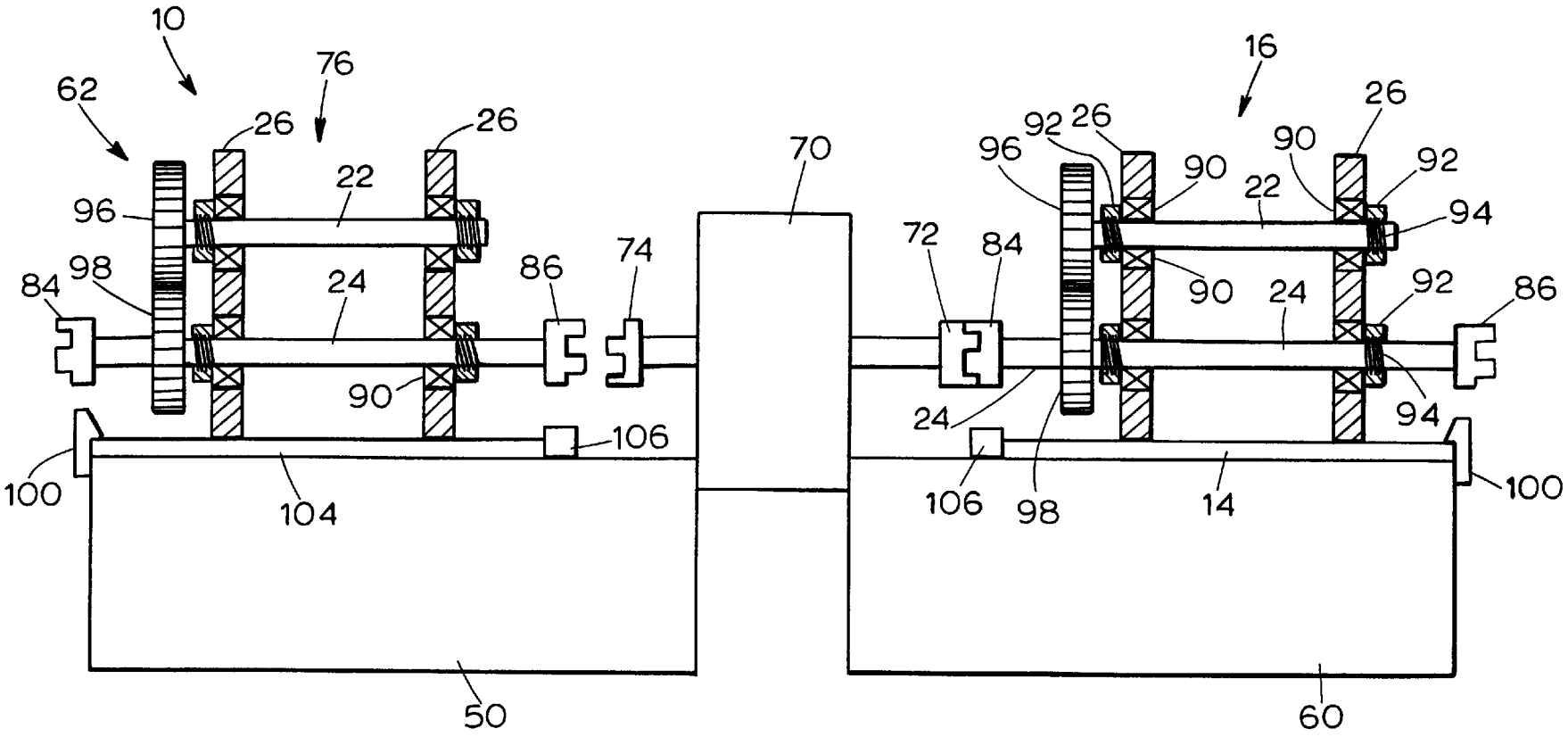
FIG. 2 is a schematic end view of the roll-forming machine of FIG. 1.
Figure 3:
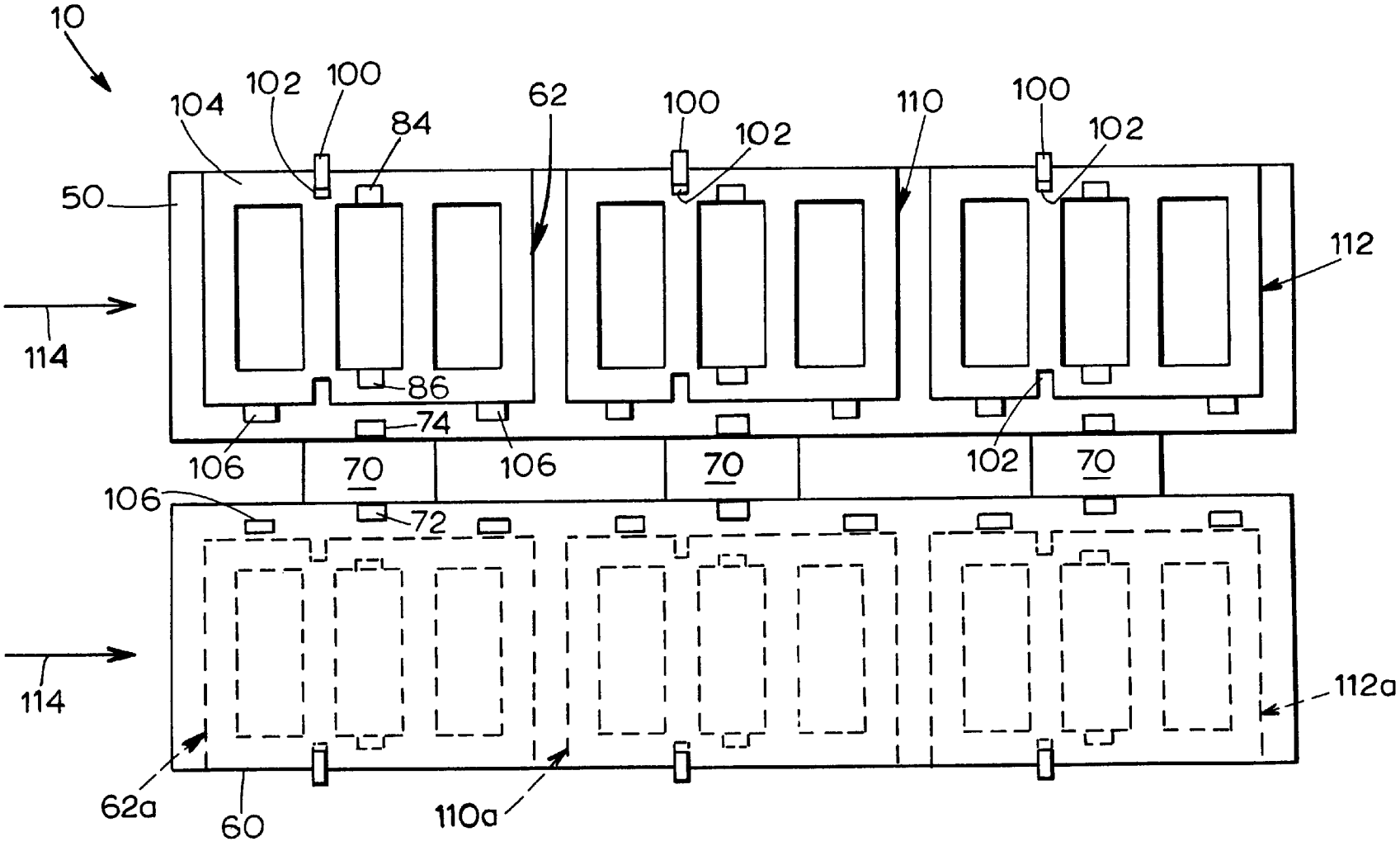
FIG. 3 is a schematic top view of a roll-forming machine in accordance with the invention.

FIG. 2 is an end view of the roll-forming machine 10. Referring to FIG. 2, the roll-forming machine 10 is provided with two elongate base portions 50, 60, each of which may be adapted to support a plurality of raft assemblies. The base portion 60 supports the raft assemblies 12, 32 (see also FIG. 1), while the base portion 50 is shown to support a raft assembly 62. As shown in FIG. 3, the base portions 50, 60 are disposed in a side-by-side relationship so that the central longitudinal axes of the two base portions 50, 60 are parallel to each other.

Where the roll-forming machine 10 is used with additional equipment, such as an uncoiler for uncoiling a web of material prior to its passing through the roll-forming machine 10, the base portions 50, 60 may be provided on rollers (not shown) and the roll-forming machine 10 may be provided with a positioning mechanism (not shown) for moving the base portions 50 and 60 in a direction transverse to the direction in which the web passes through the roll-forming machine 10 to facilitate the alignment of the roll-forming machine 10 with respect to such additional equipment.

Referring to FIGS. 2 and 3, a plurality of drive mechanisms 70 are mounted between the two base portions 50, 60. The drive mechanism 70 shown in FIG. 2 has a horizontally translatable coupler 72 which extends towards the roll-forming station 16 of the raft assembly 12 mounted on the base portion 60 and a second horizontally translatable coupler 74 which extends towards a roll-forming station 76 of the raft assembly 62 mounted on the base portion 50.

The roll-forming station 16 has a coupler 84 that extends towards the coupler 72 and which is adapted to engage the coupler 72 and a second coupler 86 that extends away from the coupler 72 and which is adapted to engage the coupler 74. The two couplers 84, 86 are mounted to the lower spindle 24 in a fixed manner so that rotation of either of the couplers 84, 86 causes the lower spindle 24 to rotate. The particular design of the couplers is conventional and is not considered important to the invention, and other coupler designs could be utilized.

The spindles 22, 24 are rotatably journalled in a number of bearings 90, each of which is mounted in a circular bore formed in one of the frame members 26. The spindles 22, 24 are held in place via a number of nuts 92, each of which is screwed onto a threaded portion 94 of one of the spindles 22, 24. The upper spindle 22 has a gear 96 mounted to it in a fixed manner, and the lower spindle 24 has a similarly mounted gear 98. The gears 96, 98 are in meshing contact so that rotation of the lower spindle 24 causes rotation of the upper spindle 22.

Referring to FIG. 2, each of the drive mechanisms 70 may cause one of its associated couplers 72, 74 to be translated outwardly towards a respective one of the couplers 84, 86 so that either the coupler 72 engages the coupler 84 or the coupler 74 engages the coupler 86. The couplers 84, 86 of the raft assemblies 12, 62 are aligned relative to the couplers 72, 74 of the drive mechanism 70 by positioning the raft assemblies 12, 62 on the base portions 50, 60 so that each of a number of outer guide members 100 mounted on the base portions 50, 60 is disposed within an alignment slot 102 (see FIG. 3) formed in the raft plates 14, 104. The raft assemblies 12, 62 are positioned on the bases 50, 60 so that the inboard edges of the raft plates 14, 104 are flush with a plurality of inner guide members 106.

FIG. 3 is a schematic top view of the roll-forming machine 10 in which three raft assemblies 62, 110, 112 are positioned on the base 50 and in which no raft assemblies are positioned on the base 60. The direction in which a sheet or web of material travels through the roll-forming machine 10 when in operation is indicated by arrows 114.

Due to the symmetrical configuration of each of the raft assemblies 62, 110, 112 and due to the fact that at least one of the roll-forming stations of each raft assembly 62, 110, 112 has couplers 84, 86 on both of its sides which are adapted to engage one of the couplers 72, 74 of the drive mechanisms 70, the raft assemblies 62, 110, 112 can be used on either the base portion 50, as shown, or can be moved to the base portion 60 to the positions shown via the dotted lines 62*a*, 110*a*, 112*a*, respectively.

It should be noted that, for example, when the raft assembly 62 is moved from the base portion 50 to the position 62*a* indicated on the base portion 60, the material passes through the three roll-forming stations of the raft assembly 62 in the same order. Consequently, when the raft assemblies 62, 110, 112 are moved from the base portion 50 to the positions 62*a*, 110*a*, 112*a* on the base portion 60, the sheet or web of material may be formed into a product having the same cross-sectional shape as when the raft assemblies 62, 110, 112 were mounted on the base portion 50.

In operation, the roll-forming machine 10 is initially configured by positioning, with a crane or other hoisting device, a plurality of raft assemblies on top of one of the base portions 50 or 60. One of the couplers 72 or 74 of each of the drive mechanisms 70 is then caused to engage, for example by being translated outwardly, a respective one of the couplers 84 or 86 of each of the raft assemblies 62, 110, 112. A sheet or web of material is then passed, in the direction indicated by arrows 114, through the roll-forming stations mounted on the raft assemblies 62, 110, 112 so that the sheet or web is deformed by the forming rolls 28 of the roll-forming stations.

The configuration of the raft assemblies can then be changed. To that end, one of the drive mechanisms 70 is disengaged from one of the couplers 84 or 86 of at least one of the raft assemblies 62, 110, 112, and at least one of the raft assemblies 62, 110, 112 is moved to the other base portion 50 or 60 and positioned on that base portion 50 or 60 so that its roll-forming stations are in the same order with respect to the web path as before. Subsequently, the drive mechanism (s) are engaged with the coupler(s) of the newly positioned raft assembly or assemblies, and a sheet or web of material is passed through the roll-forming stations of the repositioned raft assemblies or assembly.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A roll-forming apparatus, comprising:

a base portion;

a drive mechanism associated with said base portion, said drive mechanism having a coupler;

a raft plate supported by said base portion;

a plurality of roll-forming stations supported by said raft plate, one of said roll-forming stations comprising:

a plurality of forming rolls;

a plurality of rotatable spindles for supporting said forming rolls;

a first coupler adapted to be coupled to said coupler of said drive mechanism and being operatively connected to one of said spindles; and a second coupler adapted to be coupled to said coupler of said drive mechanism and being operatively connected to one of said spindles, said first and second couplers of said one roll-forming station being associated with and coupled to one of said spindles.

2. A roll-forming apparatus as defined in claim 1, wherein said first coupler of said one roll-forming station extends from a first side of said one roll-forming station in a direction towards said coupler of said drive mechanism and wherein said second coupler of said one roll-forming station extends from a second side of said one roll-forming station in a direction away from said coupler of said drive mechanism.

3. A roll-forming apparatus as defined in claim 2 wherein said first coupler of said one roll-forming station engages said coupler of said drive mechanism so that rotation of said coupler of said drive mechanism causes rotation of said first coupler of said one roll-forming station and one of said spindles.

4. A roll-forming apparatus as defined in claim 1 wherein said coupler of said drive mechanism extends towards said one roll-forming station.

5. A roll-forming apparatus as defined in claim 1 wherein each of said spindles has a central axis that is disposed in a common vertical plane and wherein said one roll-forming station additionally comprises:

a pair of spaced-apart frame members for supporting said spindles, each of said spindles passing through both of said frame members;

a first gear connected to a first of said spindles; and a second gear connected to a second of said spindles, said first and second gears being enmeshed so that rotation of said first spindle causes said second spindle to rotate.

6. A roll-forming apparatus, comprising:

a first elongate base portion having an axis extending in a longitudinal direction;

a second elongate base portion having an axis disposed generally parallel to said longitudinal direction of said axis of said first base portion;

a drive mechanism associated with said first and second base portions, said drive mechanism having a first coupler associated with said first base portion and a second coupler associated with said second base portion;

a raft plate supported by said first base portion;

a plurality of roll-forming stations supported by said raft plate, one of said roll-forming stations comprising:

a plurality of forming rolls;

a plurality of rotatable spindles for supporting said forming rolls;

a first coupler adapted to be coupled to one of said couplers of said drive mechanism and being operatively connected to one of said spindles; and a second coupler adapted to be coupled to one of said couplers of said drive mechanism and being operatively connected to one of said spindles, said first and second couplers of said one roll-forming station being associated with and coupled to one of said spindles.

7. A roll-forming apparatus as defined in claim 6, wherein said first coupler of said one roll-forming station extends from a first side of said one roll-forming station in a direction towards one of said couplers of said drive mechanism and wherein said second coupler of said one roll-forming station extends from a second side of said one roll-forming station in a direction away from one of said couplers of said drive mechanism.

8. A roll-forming apparatus as defined in claim 7 wherein said first coupler of said one roll-forming station engages one of said couplers of said drive mechanism so that rotation of said one coupler of said drive mechanism causes rotation of said first coupler of said one roll-forming station and one of said spindles.

9. A roll-forming apparatus, comprising:

a first elongate base portion having an axis extending in a longitudinal direction;

a second elongate base portion having an axis disposed generally parallel to said longitudinal direction of said axis of said first base portion;

a drive mechanism associated with said first and second base portions, said drive mechanism having a first coupler associated with said first base portion and a second coupler associated with said second base portion;

a raft plate supported by said first base portion;

a plurality of roll-forming stations supported by said raft plate, one of said roll-forming stations comprising:

a plurality of forming rolls;

a plurality of rotatable spindles for supporting said forming rolls;

a first coupler adapted to be coupled to one of said couplers of said drive mechanism and being operatively connected to one of said spindles; and a second coupler adapted to be coupled to one of said couplers of said drive mechanism and being operatively connected to one of said spindles, wherein each of said spindles has a central axis that is disposed in a common vertical plane and wherein said one roll-forming station additionally comprises:

a pair of spaced-apart frame members for supporting said spindles, each of said spindles passing through both of said frame members;

a first gear connected to a first of said spindles; and a second gear connected to a second of said spindles, said first and second gears being enmeshed so that rotation of said first spindle causes said second spindle to rotate.

10. A roll-forming apparatus, comprising:

a first elongate base portion having an axis extending in a longitudinal direction;

a second elongate base portion having an axis disposed generally parallel to said longitudinal direction of said axis of said first base portion;

a drive mechanism associated with said first and second base portions, said drive mechanism having a first coupler associated with said first base portion that extends towards said first base portion and a second coupler associated with said second base portion that extends towards said second base portion;

a raft plate supported by said first base portion;

a plurality of roll-forming stations supported by said raft plate, one of said roll-forming stations comprising:

a plurality of forming rolls;

a plurality of rotatable spindles for supporting said forming rolls, each of said spindles having a central axis that is disposed in a common vertical plane;

a pair of spaced-apart frame members for supporting said spindles, each of said spindles passing through both of said frame members;

a first gear connected to a first of said spindles;

a second gear connected to a second of said spindles, said first and second gears being enmeshed so that rotation of said first spindle causes said second spindle to rotate;

a first coupler adapted to be coupled to one of said couplers of said drive mechanism and being mounted to one of said spindles, said first coupler of said one roll-forming station extending from a first side of said one roll-forming station in a direction towards said one coupler of said drive mechanism, said first coupler of said one roll-forming station engaging said one coupler of said drive mechanism so that rotation of said one coupler of said drive mechanism causes rotation of said first coupler of said one roll-forming station and one of said spindles; and a second coupler adapted to be coupled to said coupler of said drive mechanism and being mounted to one of said spindles, said second coupler of said one roll-forming station extending from a second side of said one roll-forming station in a direction away from said drive mechanism.

11. A roll-forming apparatus as defined in claim 10 wherein said first and second couplers of said one roll-forming station are mounted on one of said spindles.

12. A roll-forming apparatus, comprising:

a raft plate;

a plurality of roll-forming stations supported by said raft plate, one of said roll-forming stations comprising:

a plurality of forming rolls;

a plurality of rotatable spindles for supporting said forming rolls;

a first coupler extending in a first direction and being adapted to be coupled to a coupler of a drive mechanism, said first coupler being operatively connected to one of said spindles; and a second coupler extending in a second direction and adapted to be coupled to a coupler of said drive mechanism, said second coupler being operatively connected to one of said spindles so that said spindles may be rotatably driven via either said first or second couplers, said first and second couplers of said one roll-forming station being associated with and coupled to one of said spindles.

13. A method of operating a roll-forming apparatus having a first base portion, a second base portion, a drive mechanism, and a plurality of roll-forming stations supported on a raft plate including a first roll-forming station and a second roll-forming station, each of said roll-forming stations having a different forming-roll configuration and one of said roll-forming stations having a pair of couplers, said method comprising the steps of:

(a) mounting said roll-forming stations supported by said raft onto said first base portion of said roll-forming apparatus so that said roll-forming stations have an orientation;

(b) causing said drive mechanism to engage said first coupler of said one roll-forming station;

(c) passing a sheet of material through said roll-forming stations supported by said raft plate in a feed direction so that said sheet of material is deformed first by said first roll-forming station and then by said second roll-forming station;

(d) causing said first coupler of said one roll-forming station to become disengaged from said drive mechanism;

(e) moving said roll-forming stations supported by said raft from said first base portion to said second first base portion so that said roll-forming stations have the same orientation as when said roll-forming stations were mounted during said step (a);

(f) causing said drive mechanism to engage said second coupler of said one roll-forming station; and (g) passing a sheet of material through said roll-forming stations supported by said raft plate in a feed direction so that said sheet of material is deformed first by said first roll-forming station and then by said second roll-forming station.

14. A roll-forming apparatus, comprising:

a raft plate;

a plurality of roll-forming stations supported by said raft plate, one of said roll-forming stations comprising:

a plurality of forming rolls;

a first rotatable spindle that supports one of said forming rolls;

a second rotatable spindle that supports another of said forming rolls, said second rotatable spindle being disposed above said first rotatable spindle;

a first coupler adapted to be coupled to a coupler of a drive mechanism, said first coupler being operatively connected to one of said spindles; and a second coupler adapted to be coupled to a coupler of said drive mechanism, said second coupler being operatively connected to one of said spindles, said first coupler of said one roll-forming station extending from a first side of said one roll-forming station in a first direction and said second coupler of said one roll-forming station extending from a second side of said one roll-forming station in a second direction away from said first direction.

15. A roll-forming apparatus as defined in claim 14 wherein each of said roll-forming stations comprises:

a plurality of forming rolls;

a first rotatable spindle that supports one of said forming rolls;

a second rotatable spindle that supports another of said forming rolls, said second rotatable spindle being disposed above said first rotatable spindle;

a first coupler adapted to be coupled to a coupler of a drive mechanism, said first coupler being operatively connected to one of said spindles; and a second coupler adapted to be coupled to a coupler of said drive mechanism, said second coupler being operatively connected to one of said spindles, said first coupler of said one roll-forming station extending from a first side of said one roll-forming station in a first direction and said second coupler of said one roll-forming station extending from a second side of said one roll-forming station in a second direction away from said first direction.

* * * * *